US009888321B2

(12) United States Patent
Kuribayashi et al.

(10) Patent No.: US 9,888,321 B2
(45) Date of Patent: Feb. 6, 2018

(54) LOUDSPEAKER, ELECTRONIC APPARATUS USING SAME, AND MOBILE APPARATUS

(71) Applicant: Panasonic Intellectual Property Management Co., Ltd., Osaka (JP)

(72) Inventors: Ryo Kuribayashi, Osaka (JP); Kazutaka Kubo, Osaka (JP); Yohei Jin, Mie (JP); Hitoshi Sato, Mie (JP); Hiroyuki Morimoto, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/075,107

(22) Filed: Mar. 19, 2016

(65) Prior Publication Data

US 2016/0205477 A1 Jul. 14, 2016

Related U.S. Application Data

(63) Continuation of application No. PCT/JP2014/004545, filed on Sep. 4, 2014.

(30) Foreign Application Priority Data

Sep. 26, 2013 (JP) ..... 2013-199518

(51) Int. Cl.
*H04R 1/02* (2006.01)
*H04R 1/20* (2006.01)
(Continued)

(52) U.S. Cl.
CPC ..... *H04R 7/14* (2013.01); *F21V 7/048* (2013.01); *F21V 7/22* (2013.01); *F21V 33/0056* (2013.01);
(Continued)

(58) Field of Classification Search
CPC ..... H04R 1/028; H04R 7/00; H04R 7/14
(Continued)

(56) References Cited

U.S. PATENT DOCUMENTS 6,447,134 B1 * 9/2002 Takahashi ..... G01D 11/28 362/618
2003/0117728 A1 * 6/2003 Hutzel ..... B60R 1/008 359/838
(Continued)

FOREIGN PATENT DOCUMENTS

DE 10303030 8/2004
DE 102006035574 1/2008
(Continued)

OTHER PUBLICATIONS

International Search Report of PCT application No. PCT/JP2014/004545 dated Oct. 21, 2014.
(Continued)

*Primary Examiner* — Vivian Chin
*Assistant Examiner* — Ubachukwu Odunukwe
(74) *Attorney, Agent, or Firm* — McDermott Will & Emery LLP

(57) ABSTRACT

A loudspeaker includes a frame, a magnetic circuit provided with a magnetic gap, a cone-shaped diaphragm, a voice coil, and an LED. The magnetic circuit is connected to a lower part of the frame. The diaphragm is connected to an outer periphery of the frame. A first end of the voice coil is connected to the diaphragm, and a second end thereof is inserted into the magnetic gap. The LED is provide on an upper part of the frame, and outputs light toward the center of the diaphragm. The LED is disposed such that the diaphragm reflects the light.

11 Claims, 9 Drawing Sheets

(51) Int. Cl.

| | |
|---|---|
| ***H04R 7/14*** | (2006.01) |
| ***F21V 7/04*** | (2006.01) |
| ***F21V 7/22*** | (2006.01) |
| ***F21V 33/00*** | (2006.01) |
| ***H04R 7/12*** | (2006.01) |
| ***H04R 9/02*** | (2006.01) |
| *F21Y 101/02* | (2006.01) |
| *F21Y 105/00* | (2016.01) |

(52) U.S. Cl.
CPC ..... *H04R 1/025* (2013.01); *H04R 1/028* (2013.01); *H04R 7/122* (2013.01); *H04R 7/127* (2013.01); *H04R 9/025* (2013.01); *F21Y 2101/02* (2013.01); *F21Y 2105/003* (2013.01); *H04R 2201/028* (2013.01); *H04R 2207/021* (2013.01); *H04R 2307/025* (2013.01); *H04R 2307/029* (2013.01); *H04R 2499/11* (2013.01); *H04R 2499/13* (2013.01)

(58) Field of Classification Search
USPC ..... 381/334, 386
See application file for complete search history.

(56) References Cited

U.S. PATENT DOCUMENTS

2004/0175014 A1* 9/2004 Liu ..... H04R 1/028 381/386
2006/0008111 A1* 1/2006 Nagaoka ..... H04R 7/122 381/423
2007/0009133 A1 1/2007 Gerkinsmeyer
2007/0279911 A1* 12/2007 Kittelmann ..... F21L 4/005 362/328
2014/0192513 A1* 7/2014 Yim ..... F21V 33/0056 362/86
2014/0254833 A1* 9/2014 Greene, IV ..... H04R 1/34 381/118

FOREIGN PATENT DOCUMENTS

| | | | |
|---|---|---|---|
| JP | 59-144983 | U | 9/1984 |
| JP | 59-169177 | U | 11/1984 |
| JP | 2-103987 | U | 8/1990 |
| JP | 2-120993 | U | 10/1990 |
| JP | 7-154894 | | 6/1995 |
| JP | 9-212107 | | 8/1997 |
| JP | 11-164378 | | 6/1999 |
| JP | 3095292 | U | 7/2003 |
| JP | 2003-259483 | | 9/2003 |
| JP | 2005-252424 | | 9/2005 |
| JP | 3131927 | U | 5/2007 |
| JP | 2008-252611 | | 10/2008 |
| JP | 2011-176621 | | 9/2011 |

OTHER PUBLICATIONS

The Extended European Search Report dated Aug. 5, 2016 for the related European Patent Application No. 14849380.2.

* cited by examiner

LOUDSPEAKER, ELECTRONIC APPARATUS USING SAME, AND MOBILE APPARATUS

BACKGROUND

1. Technical Field

The present disclosure relates to a loudspeaker having an illuminating function, and an electronic apparatus and a mobile apparatus using same.

2. Background Art

A conventional loudspeaker is described below. The conventional loudspeaker includes a loudspeaker unit and an illumination part. The illumination part has a ring shape and includes a light-emitting element. The illumination part is attached to a front face of the loudspeaker unit. The illumination part is formed of transparent resin to guide light emitted from the light-emitting element.

Known patent literatures related to the present disclosure include Unexamined Japanese Patent Publication No. 119-212107.

SUMMARY

A loudspeaker of the present disclosure includes a frame, a magnetic circuit provided with a magnetic gap, a cone-shaped diaphragm, a voice coil, and an LED. The magnetic circuit is connected to a lower part of the frame. The diaphragm has a front face and a rear face. The rear face of the diaphragm is connected to an outer periphery of the frame. The voice coil has a first end and a second end. The first end of the voice coil is connected to the diaphragm. The second end of the voice coil is inserted into the magnetic gap. The LED outputs light toward the center of the diaphragm, and is provided on an upper part of the frame such that the light is reflected on the front face of the diaphragm.

With the above structure, light output from the LED is reflected at multiple points on the front surface of the diaphragm. Accordingly, a complicated light pattern appears on the diaphragm. Furthermore, since the diaphragm has a cone shape, the pattern looks three-dimensional by mutual interference of lights reflected on the surface of the diaphragm. As a result, the loudspeaker of the present disclosure can be decorated with illumination of an extremely complicated light pattern, and furthermore an image with three-dimensional appearance.

DETAILED DESCRIPTION OF PREFERRED EMBODIMENTS

Prior to describing loudspeaker 11 in accordance with the exemplary embodiment, a disadvantage of a conventional loudspeaker is described.

In the conventional loudspeaker, just an illumination part shines. Accordingly, a light pattern that appears on the loudspeaker is simple. An object of the loudspeaker in accordance with the exemplary embodiment is to decorate the loudspeaker with illumination of a complicated light pattern and image.

Figure 1:
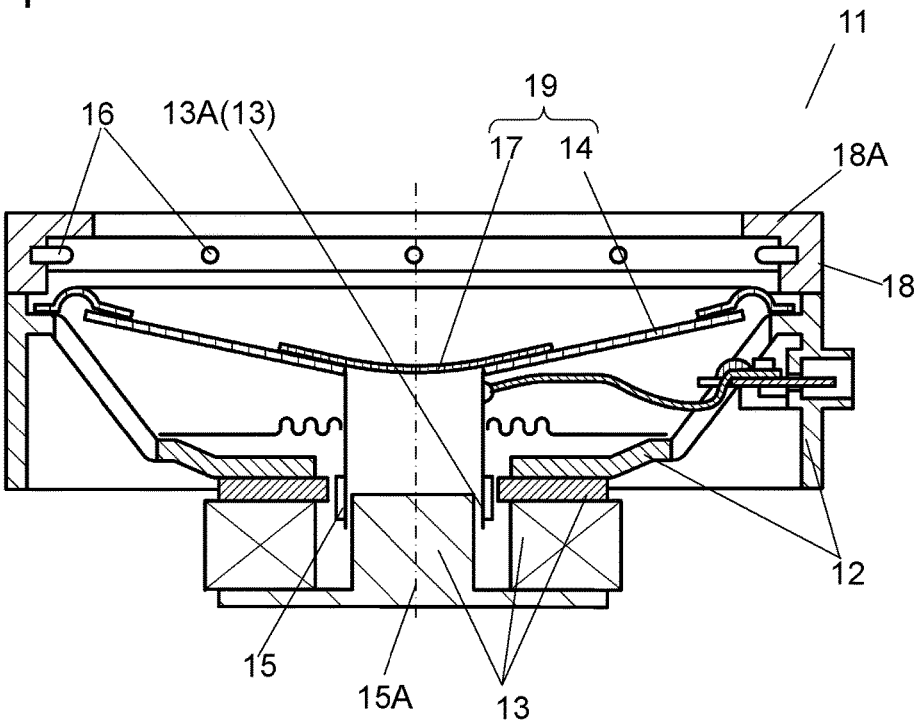
FIG. 1 is a sectional view of a loudspeaker in accordance with an exemplary embodiment of the present disclosure.
Figure 2:
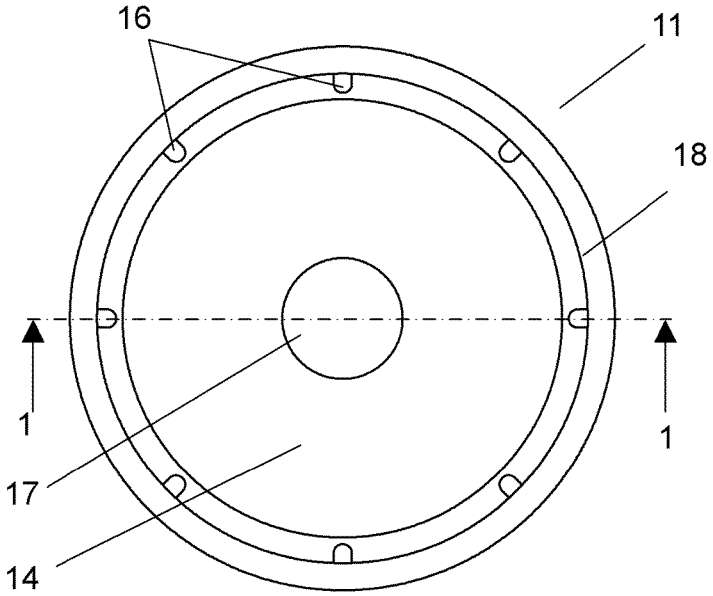
FIG. 2 is a front view of the loudspeaker in accordance with the exemplary embodiment of the present disclosure.

The loudspeaker in accordance with the exemplary embodiment is described below with reference to drawings. FIG. 1 is a sectional view of loudspeaker 11. FIG. 2 is a front view of loudspeaker 11. FIG. 1 shows the view taken along line 1-1 in FIG. 2.

Loudspeaker 11 includes frame 12, magnetic circuit 13 provided with magnetic gap 13A, cone-shaped diaphragm 14, voice coil 15, and light-emitting diode 16 (hereinafter referred to as "LED 16"). Frame 12 includes an upper part and a lower part opposite to the upper part. Diaphragm 14 includes a front face and a rear face opposite to the front face. Loudspeaker 11 further preferably includes dust cap 17.

Magnetic circuit 13 is connected to the center of the lower part of frame 12. Diaphragm 14 is connected to an outer periphery of frame 12. Voice coil 15 includes a first end and a second end. The second end is formed on the opposite side of the first end. The first end of voice coil 15 is connected to diaphragm 14. Specifically, the first end of voice coil 15 is connected to the rear face of diaphragm 14. The first end of voice coil 15 may alternatively be connected to the side face of an inner periphery or the front face of diaphragm 14, besides the configuration of connecting the first end to the rear face of diaphragm 14. On the other hand, the second end of voice coil 15 is inserted into magnetic gap 13A.

LED 16 is disposed on the upper part of frame 12, and faces the center of diaphragm 14. With this configuration, LED 16 outputs light toward the center of diaphragm 14. In this case, LED 16 is disposed such that light output from LED 16 is reflected on the front face of diaphragm 14.

Figure 3:
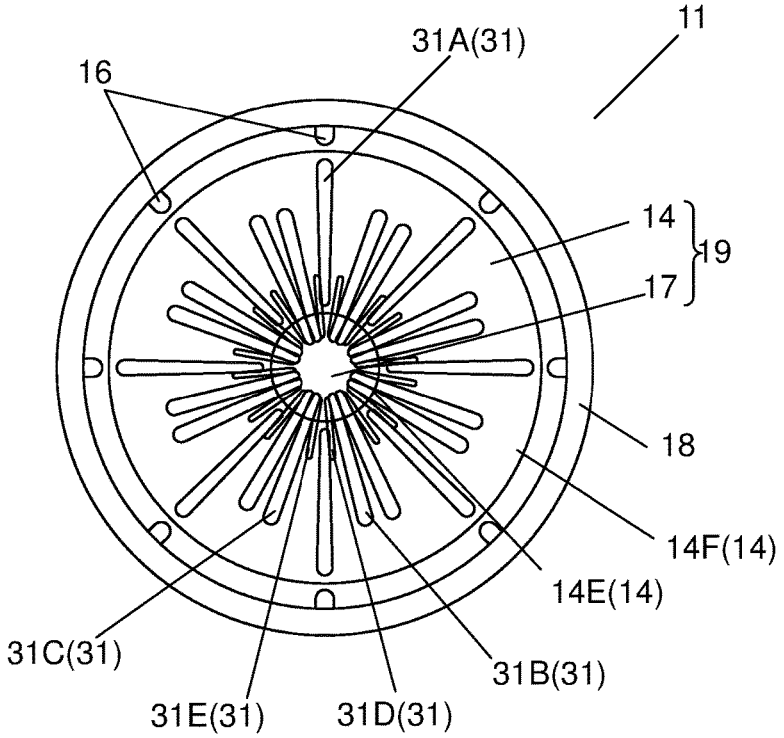
FIG. 3 is a schematic diagram of a light pattern that appears on the loudspeaker in a light-emitting state in accordance with the exemplary embodiment of the present disclosure.
Figure 4:
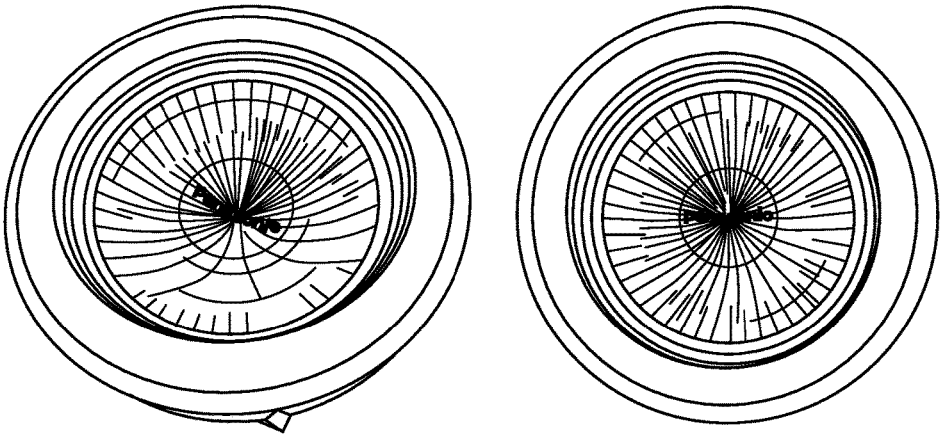
FIG. 4 is a photo observation view of the loudspeaker in the light-emitting state taken from the front in accordance with the exemplary embodiment of the present disclosure.

FIG. 3 is a schematic diagram of a light pattern that appears on loudspeaker 11 in the light-emitting state. FIG. 4 is a photo observation view of loudspeaker 11 in the light-emitting state taken from the front face.

A general small light bulb diffuses and outputs light in all directions from the light bulb. Accordingly, if a small light bulb is used as a light source instead of LED 16, it just makes the entire front face of diaphragm 14 bright. On the other hand, LED 16 can output light with higher linearity than general small light bulbs. Accordingly, linear pattern 31 can be formed on diaphragm 14 by the light output from LED 16.

With the above configuration, the light output from LED 16 is reflected at multiple points on the front surface of diaphragm 14. Accordingly, complicated light pattern 31 formed of multiple straight portions appears on diaphragm 14. Still more, cone-shaped diaphragm 14 makes pattern 31 look like a three-dimensional light image by mutual interference of lights reflected on the surface of diaphragm 14. As a result, loudspeaker 11 can be decorated with illumination of extremely-complicated light pattern 31, and furthermore an image with three-dimensional appearance.

Next, loudspeaker 11 is described in detail. The shape of diaphragm 14 when seen from the front face is preferably round (a circle). In case of round diaphragm 14, an outer shape of loudspeaker 11 is also preferably round. Meanwhile, the shape of diaphragm 14 seen from the front face is not limited to round. For example, an oval, rectangular, or track type diaphragm is also acceptable.

As shown in FIG. 1, LED fixing part 18 is provided on the upper part of frame 12. LED fixing part 18 has an annular shape. With this configuration, LED fixing part 18 can also serve as a gasket. LED 16 is placed on the inner periphery of LED fixing part 18. In a case where diaphragm 14 is round seen from the front face, LED fixing part 18 preferably has an annular shape.

Frame 12 may include LED fixing part 18. In this case, LED fixing part 18 is preferably molded integrally with frame 12. This configuration eliminates the need of assembling LED fixing part 18 and frame 12 separately. Accordingly, an assembly man-hour of loudspeaker 11 can be reduced.

Shielding 18A and LED fixing part 18 are integrally formed. However, the configuration is not limited. Shielding 18A and LED fixing part 18 may also be formed separately.

LED 16 is placed such that an optical axis of LED 16 crosses central axis 15A of voice coil 15 shown in FIG. 1 at right angles. Alternatively, LED 16 may also be placed on a tilt such that its tip faces toward the front face of diaphragm 14. The shape and brightness of pattern 31 shown in FIG. 3 can be adjusted by adjusting an angle between the optical axis of LED 16 and central axis 15A.

As shown in FIG. 3, multiple LEDs 16 are provided on LED fixing part 18. This configuration enables to form complicated pattern 31 using multiple light rays on diaphragm 14. In this case, LEDs 16 are preferably disposed away from each other. This configuration enables to suppress shining of entire diaphragm 14. In other words, a bright area and dark area can be formed on diaphragm 14. Accordingly, light pattern 31 and image formed on diaphragm 14 look sharper and brighter.

Multiple LEDs 16 are preferably disposed away from each other at equal intervals. This configuration enables to form beautiful geometric pattern 31 on diaphragm 14. In this case, the shape of diaphragm 14 seen from the front face is preferably round. This configuration enables to form rotationally-symmetric pattern 31 with respect to the center of diaphragm 14.

As shown in FIG. 1, LED fixing part 18 may include shielding 18A. LEDs 16 are disposed between shielding 18A and diaphragm 14. Shielding 18A blocks light output toward the opposite side of diaphragm 14 in lights output from LEDs 16. This configuration enables to suppress the direct incidence of lights emitted from LEDs 16 into eyes when diaphragm 14 is seen from the front face. Accordingly, light pattern 31 and image look sharper and brighter. Shielding 18A can also serve as a gasket.

Shielding 18A is preferably integrally molded with LED fixing part 18. This configuration enables to reduce an assembly man-hour of LED fixing part 18. However, the structure of shielding 18A and LED fixing part 18 is not limited to integral molding. Shielding 18A and LED fixing part 18 may be formed separately.

LED fixing part 18 preferably has a color darker than that of the front face of diaphragm 14. In other words, LED fixing part 18 preferably has a color with a reflectivity lower than that of the front face of diaphragm 14. The most preferable color for LED fixing part 18 is black. Still more, the surface of LED fixing part 18 preferably has unevenness. For example, the surface of LED fixing part 18 is embossed. This configuration can make the surface of LED fixing part 18 less glossy. Accordingly, LED fixing part 18 can suppress reflection of light output from LEDs 16. As a result, light pattern 31 and image shown in FIG. 3 look sharper and brighter.

Dust cap 17 is provided at the center of diaphragm 14. Dust cap 17 is preferably protruded from diaphragm 14 toward magnetic circuit 13. Dust cap 17 having this configuration does not block light emitted from LED 16. Accordingly, pattern 31 shown in FIG. 3 can be formed on a bonded part of diaphragm 14 and dust cap 17 and also on dust cap 17. The rear face of dust cap 17 is disposed facing the front face of diaphragm 14.

A cross-sectional shape of dust cap 17 when cut along the axis of voice coil 15 is preferably curved. In particular, dust cap 17 is preferably arc-shaped in cross section. This configuration enables to clearly form light pattern 31 shown in FIG. 3 also on the front face of dust cap 17. Still more, assembly 19 formed of diaphragm 14 and dust cap 17 has a cone shape. The surface of assembly 19 thus serves as a concave mirror. As a result, an image formed by lights output from LEDs 16 looks three-dimensional. In other words, a light image looks as if it is protruding and positioned closer than the front face of diaphragm 14, or farther than the front face.

Next, diaphragm 14 is described in detail. In general, a diaphragm made of paper has pin holes and uneven surface due to fibers. The front face of paper diaphragm thus diffusely reflects light. Accordingly, the paper diaphragm becomes just bright as a whole. In other words, it is difficult to form a clear pattern or image on diaphragm 14 if diaphragm 14 is made of paper. Therefore, diaphragm 14 is made of resin and preferably made by resin molding. The surface of diaphragm 14 made by resin molding is smoother than that of the diaphragm made of paper. Accordingly, diffused reflection of lights output from LEDs 16 on the front face of diaphragm 14 can be suppressed. As a result, pattern 31 and image shown in FIG. 3 look sharp and bright.

The front face of diaphragm 14 preferably has a color brighter than that of the rear face. In other words, the front face of diaphragm 14 preferably has a reflectivity higher than that of the rear face. This configuration achieves a high light reflectivity on the front face of diaphragm 14. Accordingly, light pattern 31 and image shown in FIG. 3 look sharper and brighter. In particular, the color of the front face of diaphragm 14 is preferably silver. In this case, a color to be output from LED 16 can be selected from a broad range. For example, LED 16 may emit white, green, blue, or red light. The color of the front face of diaphragm 14 may also be white. In this case, the color of LED 16 is preferably other than white.

Figure 5:
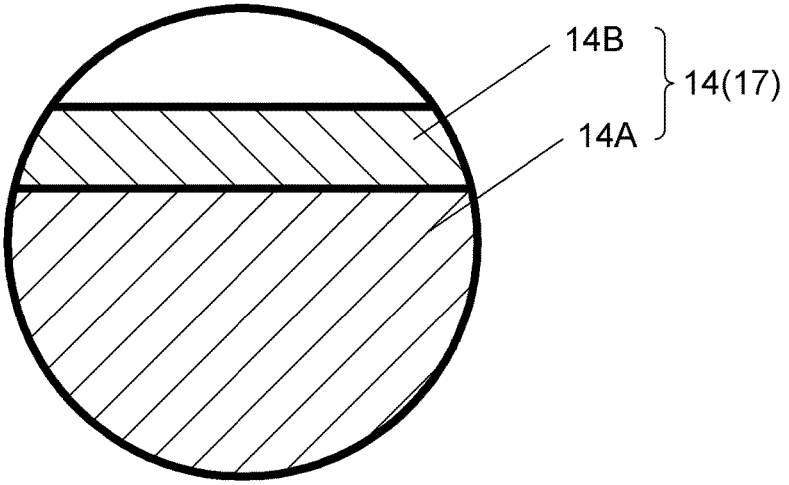
FIG. 5 is a magnified sectional view of a key part of the diaphragm in accordance with the exemplary embodiment of the present disclosure.

FIG. 5 is a magnified sectional view of a key part of diaphragm 14. Diaphragm 14 preferably includes base layer 14A and reflective material layer 14B. Reflective material layer 14B is formed on the front face of diaphragm 14. Reflective material layer 14B preferably has a color brighter than that of base layer 14A. In other words, the front face of diaphragm 14 has a higher reflectivity than that of the rear face. This configuration improves reflectivity of light output from LED 16 on the front face of diaphragm 14. Reflective material layer 14B can be formed by attaching, painting, depositing, or plating a reflective material on base layer 14A.

Reflective material layer 14B is preferably metal. This configuration can form reflective material layer 14B with a high light reflectivity on the front face of diaphragm 14. Since hardness of metal reflective layer 14B is high, elastic modulus of diaphragm 14 can be increased. Accordingly, the sound pressure of diaphragm 14 can be increased. Metal reflective material layer 14B may be formed by deposition. However, reflective material layer 14B is not limited to metal. It may also be fluorescent paint. In this case, fluorescent paint is applied to the front face of diaphragm 14.

Reflective material layer 14B is also preferably formed on the front face of dust cap 17. This configuration makes a light image further brighter.

Figure 6:
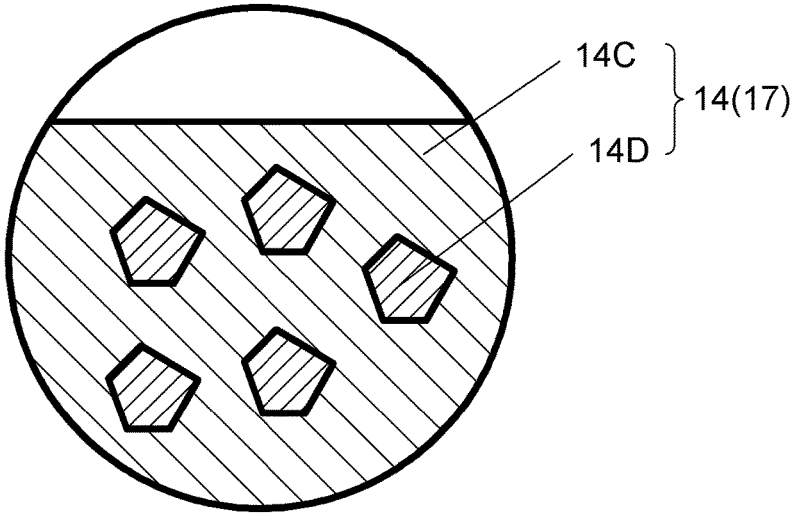
FIG. 6 is a magnified sectional view of a key part of the diaphragm including a reflective material in accordance with the exemplary embodiment of the present disclosure.

FIG. 6 is a sectional view of a key part of diaphragm 14 including a reflective material. Diaphragm 14 may include sub-material 14D in main material 14C. Main material 14C is resin. Main material 14C is, for example, polypropylene. This configuration achieves lightweight diaphragm 14. Sub-material 14D is a reflective material. In this case, the reflectivity of sub-material 14D is preferably higher than that of main material 14C. Sub-material 14D is also preferably resin. Still more, a powder fluorescent substance may be used for sub-material 14D.

Figure 7:
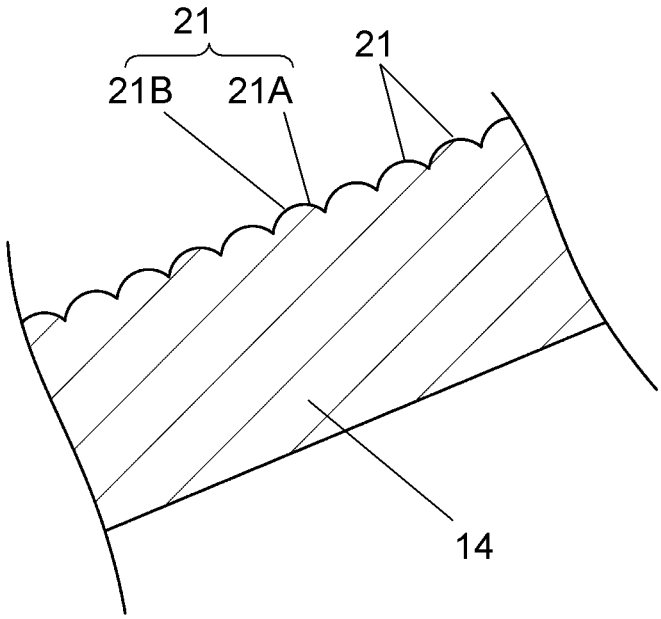
FIG. 7 is a magnified sectional view of a key part of the diaphragm in which convex parts are formed on its surface in accordance with the exemplary embodiment of the present disclosure.

FIG. 7 is a magnified sectional view of a key part of diaphragm 14 in which convex parts 21 are formed on its front face. The front face of diaphragm 14 preferably includes convex parts 21. This configuration makes the reflecting direction of light different, depending on the exposure area to the light. Accordingly, invisibility of pattern 31 shown in FIG. 3 can be suppressed when the place (viewpoint) of listener changes. Convex part 21 may also be formed on dust cap 17.

Figure 8:
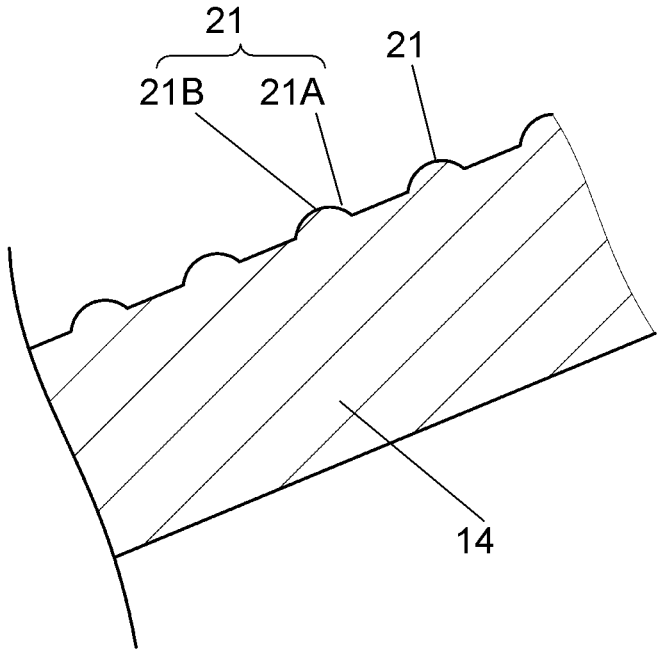
FIG. 8 is a magnified sectional view of a key part of the diaphragm in which the convex parts are disposed away from each other in accordance with the exemplary embodiment of the present disclosure.

If convex part 21 is too short, diffused reflection of light increases on the front face of diaphragm 14. In this case, the entire front face of diaphragm 14 becomes brighter. As a result, a difference between luminance of pattern 31 shown in FIG. 3 and luminance of the front face of diaphragm 14 becomes small. On the other hand, if convex part 21 is too tall, convex part 21 itself may block light, depending on the position of listener. Therefore, the height of convex part 21 is preferably in a range from 1% to 50% of the thickness of diaphragm 14, inclusive. The height of convex part 21 is further preferably in a range from 0.01 mm to 0.07 mm, inclusive. This configuration enables the listeners to clearly see pattern 31 and image shown in FIG. 3 from a broader area. In particular, convex part 21 is preferably arc-shaped in cross section. This configuration can broaden a range of viewpoint where the pattern shown in FIG. 3 can be seen clearly. FIG. 8 is a magnified sectional view of a key part of diaphragm 14 in which convex parts 21 are provided away from each other. Convex parts 21 may be placed away from each other.

Figure 9:
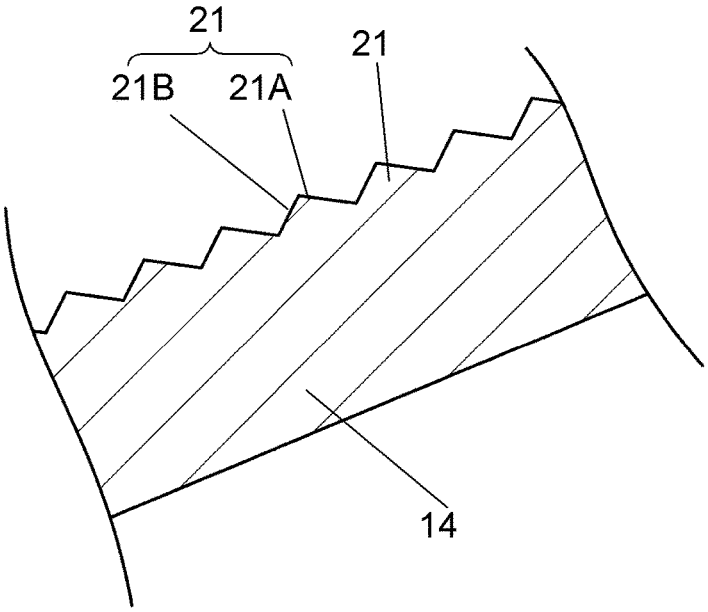
FIG. 9 is a magnified sectional view of a key part of the diaphragm in which the convex parts have linear shapes in accordance with the exemplary embodiment of the present disclosure.

FIG. 9 is a magnified sectional view of a key part of diaphragm 14 in which convex parts have linear shapes in cross section. The cross-sectional shape of convex part 21 may be configured with straight lines. A tip of convex part 21 may be chamfered. For chamfering, either R-chamfering or C-chamfering is acceptable.

More specifically, convex part 21 preferably includes at least first reflective part 21A and second reflective part 21B. First reflective part 21A is disposed so as to be tilted for a first angle with respect to the front face of diaphragm 14. On the other hand, second reflective part 21B is disposed at a second angle with respect to the front face of diaphragm 14. Note that the first angle is different from the second angle. Alternatively, first reflective part 21A may be disposed so as to be tilted for the first angle with respect to the rear face of diaphragm 14. Second reflective part 21B may be disposed at the second angle with respect to the rear face of diaphragm 14. The second angle may be 0 degree.

Arc convex part 21 has numerous reflective parts at the micro level. This means that arc convex part 21 also has first reflective part 21A and second reflective part 21B.

Figure 10:
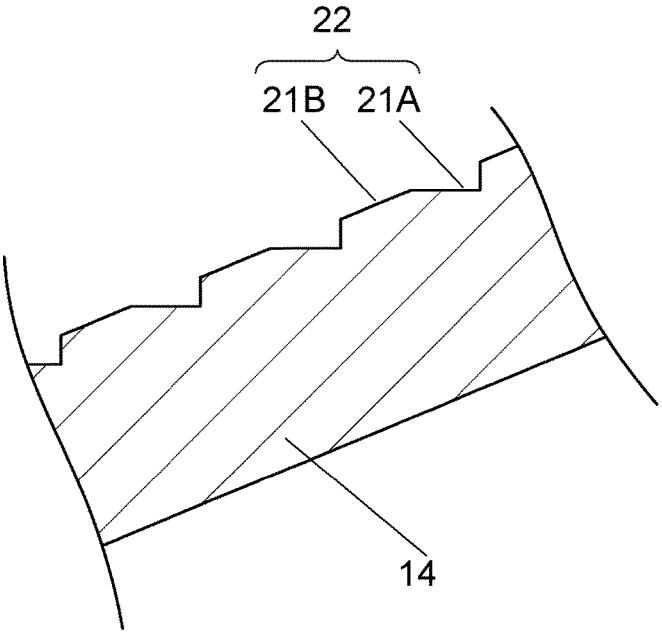
FIG. 10 is a magnified sectional view of a key part of the diaphragm in which concave parts are formed on a front face in accordance with the exemplary embodiment of the present disclosure.

FIG. 10 is a magnified sectional view of a key part of diaphragm 14 in which concave parts 22 are formed on the front face. Concave part 22 may be formed on the front face of diaphragm 14. In this case, the bottom face of concave part 22 serves as first reflective part 21A. On the other hand, the surface of the front face of diaphragm 14 serves as second reflective part 21B. Accordingly, concave parts 22 are disposed away from each other. Note that it is not limited to a configuration in which the surface of the front face of diaphragm 14 serves as second reflective parts 21B. Alternatively, first reflective part 21A and second reflective part 21B may be formed on concave part 22. In this case, adjacent concave parts 22 may be provided in a connected manner.

Figure 11:
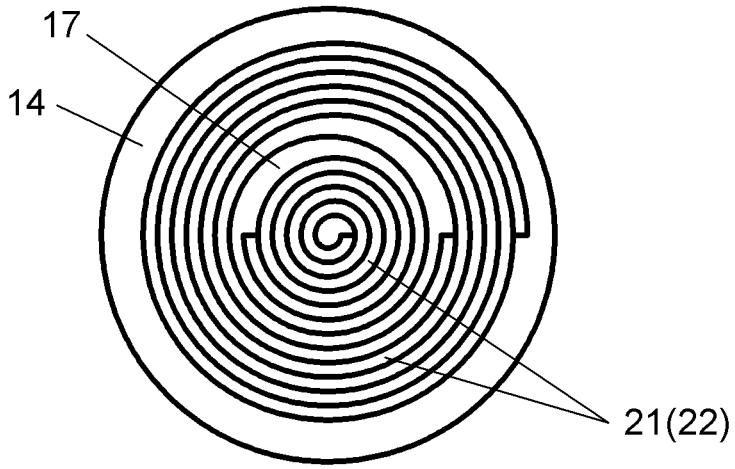
FIG. 11 is a front view of the diaphragm on which a spiral convex part is formed in accordance with the exemplary embodiment of the present disclosure.

FIG. 11 is a front view of diaphragm 14 on which spiral convex part 21 is formed. The shape of convex part 21 seen from the front face is spiral. In other words, a distance from the center to convex part 21 gradually reduces from the outer periphery to the center of diaphragm 14. This configuration facilitates formation of convex part 21 by the molds when diaphragm 14 is made by resin molding. Spiral convex part 21 is formed on diaphragm 14, but this is not limited. Spiral concave part 22 may be formed on diaphragm 14. Still more, spiral convex part 21 or concave part 22 may also be formed on dust cap 17.

Figure 12:
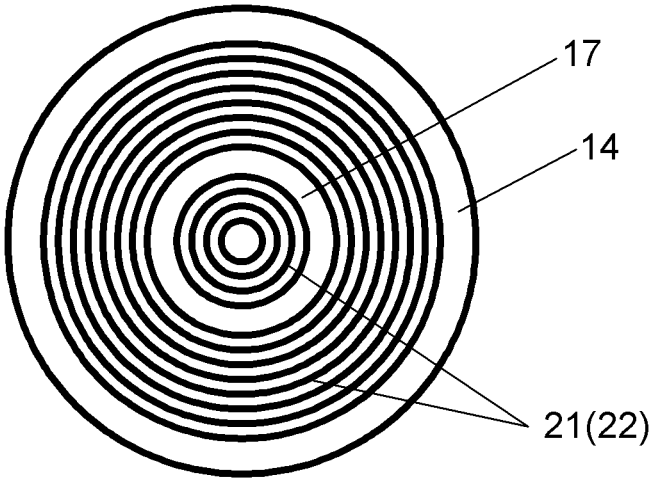
FIG. 12 is a front view of the diaphragm on which concentric convex parts are formed in accordance with the exemplary embodiment of the present disclosure.

FIG. 12 is a front view of diaphragm 14 on which concentric convex parts 21 are formed. Multiple convex parts 21 may be disposed so as to make a circuit of the front face of diaphragm 14. Convex parts 21 are preferably concentric with diaphragm 14. Concentric convex parts 21 are formed on diaphragm 14, but this is not limited. Concentric concave parts 22 may be formed on diaphragm 14. Still more, concentric convex parts 21 or concave parts 22 may also be formed on dust cap 17.

Figure 13:
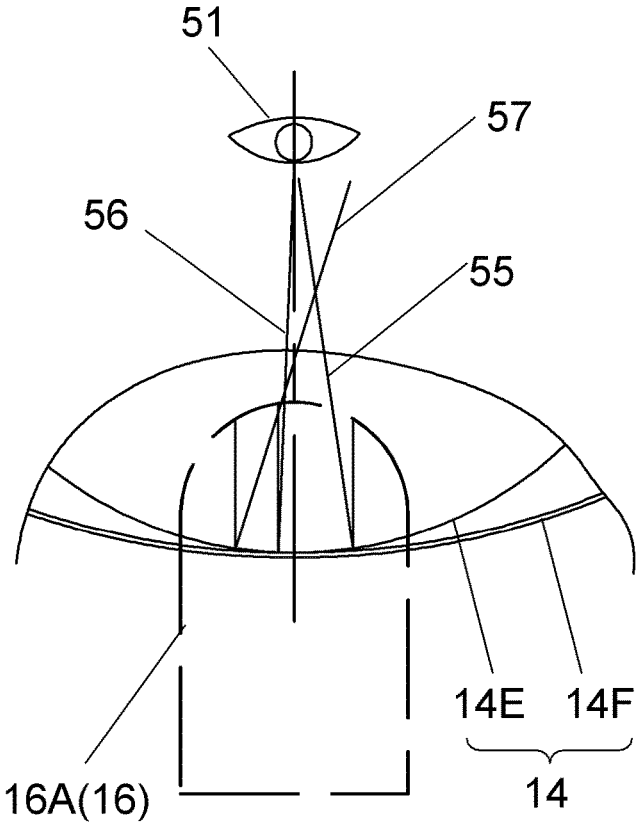
FIG. 13 is a conceptual diagram illustrating reflection of light on the diaphragm in accordance with the exemplary embodiment of the present disclosure.

Hereinafter, the pattern formed on diaphragm 14 is described in detail with reference to drawings. FIG. 13 is a conceptual diagram illustrating reflection of light on diaphragm 14. FIG. 13 shows the case of looking at diaphragm 14 in a direction of arrow A in FIG. 15. In other words, diaphragm 14 is seen on an extended line of the front face of diaphragm 14 in FIG. 13. FIG. 13 shows the case of emitting light only from LED 16A.

Light output from LED 16A has high linearity. However, the light output from LED 16A still spreads as it travels away from LED 16A. As shown in FIG. 3, however, pattern 31 that appears on diaphragm 14 is thinner toward center 14E of diaphragm 14 and thicker toward outer periphery 14F of diaphragm 14. This is because a curvature radius of diaphragm 14 gradually increases toward outer periphery 14F.

Light output from LED 16A reaches eye 51 via, for example, route 55 and route 56. In route 55, light output from LED 16A is reflected in an area near outer periphery 14F of diaphragm 14. On the other hand, in route 56, light output from LED 16A is reflected in an area near center 14E of diaphragm 14. However, light output from LED 16A that passes a point farther away from a line connecting the center of light of LED 16 and eye 51 than route 56 may go through, for example, route 57. In route 57, light output from LED 16A is reflected in an area near center 14E of diaphragm 14. As a result, the light passing route 57 does not reach eye 51.

Accordingly, in the area near center 14E of diaphragm 14, the width of reflected light entering eye 51 becomes narrow. Conversely, in the area near outer periphery 14F of diaphragm 14, the width of reflected light entering eye 51 becomes wide. With the above configuration, the width of pattern 31 changes.

Figure 14:
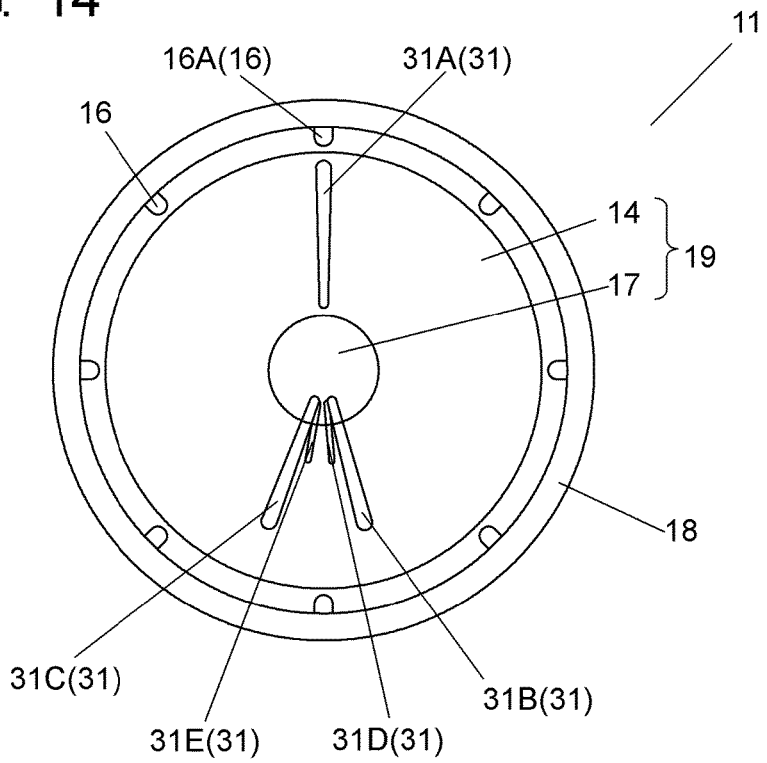
FIG. 14 is a conceptual diagram of the loudspeaker seen from the front face in the light-emitting state in accordance with the exemplary embodiment of the present disclosure.
Figure 15:
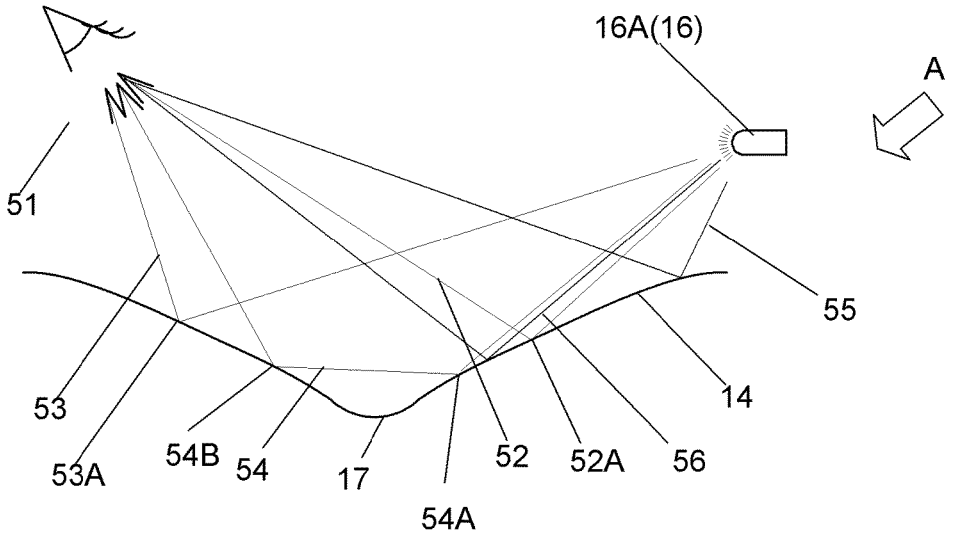
FIG. 15 is a conceptual diagram illustrating reflection of light on the diaphragm in accordance with the exemplary embodiment of the present disclosure.

FIG. 14 is a conceptual diagram of loudspeaker 11 in the light-emitting state when seen from its front face. FIG. 14 shows pattern 31 when only LED 16A is illuminated. FIG. 15 is a conceptual diagram of light reflected on diaphragm 14 when seen from its side face. Light emitted from LED 16A reaches eye 51 via, for example, first route 52, second route 53, and third route 54.

In first route 52, light output from LED 16A is reflected on point 52A. Point 52A is located on a face close to LED 16A in diaphragm 14. In other words, point 52A is provided at a position in front of the center of diaphragm 14.

First pattern 31A shown in FIG. 14 is formed in an area closer to LED 16A than to the center of diaphragm 14 by this reflected light. Since first pattern 31A is located at a position closer to LED 16A than to the center of diaphragm 14, first pattern 31A is longer and brighter than second pattern 31B, second pattern 31C, third pattern 31D, and third pattern 31E. In addition, first pattern 31A is thicker than third patterns 31D and 31E. An outer periphery of first pattern 31A is brighter and thicker than the center thereof. When diaphragm 14 is seen from the front face of loudspeaker 11, first pattern 31A and LED 16A are on the same straight line.

Next, in second route 53, light output from LED 16A is reflected on point 53A. Point 53A is located on a face farther from LED 16A than the center of diaphragm 14.

Second patterns 31B and 31C shown in FIG. 14 are formed by these reflected lights in areas on the opposite side of LED 16A with respect to the center of diaphragm 14. When diaphragm 14 is seen from the front face of loudspeaker 11, second patterns 31B and 31C are formed deviated from the line connecting LED 16A and the center of diaphragm 14. However, second pattern 31B and second pattern 31C are formed bilaterally symmetric with respect to the line connecting LED 16A and the center of diaphragm 14.

Diaphragm 14 has a cone shape. Accordingly, second pattern 31B can be seen with left eye 51. On the other hand, second pattern 31C can be seen with right eye 51. This configuration thus makes pattern 31 look like a three-dimensional image by parallax of second pattern 31B and second pattern 31C when the patterns are seen with both eyes 51.

Second patterns 31B and 31C are thicker than first pattern 31A, but their luminance is slightly low. The outer peripheries of second pattern 31B and second pattern 31C are thicker than the centers thereof. A reflecting surface of second route 53 is far from LED 16A. Accordingly, portions of second patterns 31B and 31C close to the outer periphery of diaphragm 14 are darker than portions close to the center of diaphragm 14. Still more, outer ends of second patterns 31B and 31C are positioned closer to the center than the outer end of first pattern 31A.

Diaphragm 14 is preferably curved so as to protrude toward the front face, as shown in FIG. 15. This configuration makes diaphragm 14 itself block light passing first route 52 near the center of diaphragm 14. The inner ends closer to the center of diaphragm 14 in ends of second patterns 31B and 31C are thus positioned closer to the center than the inner end of first pattern 31A. Accordingly, pattern 31 with an extremely complicated shape is formed on diaphragm 14. Still more, an angle of diaphragm 14 crossing voice coil 15 shown in FIG. 1 can be made larger. Accordingly, loudspeaker 11 can reproduce up to high-frequency sounds.

In third route 54, light output from LED 16A is reflected on two points, i.e., point 54A and point 54B, and reaches eye 51. Point 54A is located on a surface closer to the LED 16A than the center of diaphragm 14. Point 54B is located on a surface farther from LED 16A than the center of diaphragm 14. In other words, light output from LED 16A is reflected in front of the center of diaphragm 14, and then is reflected again at back of the center of diaphragm 14 again. The reflected lights form third pattern 31D and third pattern 31E in an area on the opposite side of LED 16A with respect to the center of diaphragm 14.

When diaphragm 14 is seen from the front face, third patterns 31D and 31E are also formed bilaterally symmetric with respect to a line connecting LED 16A and the center of diaphragm 14. Third pattern 31D can be seen with left eye 51. On the other hand, third pattern 31E can be seen with right eye 51. Accordingly, pattern 31 looks like a three-dimensional image by parallax of third patterns 31D and 31E when they are seen with both eyes 51.

However, since third pattern 31D and third pattern 31E are formed by lights reflected twice, they are darker than first pattern 31A, second pattern 31B, and second pattern 31C. Third pattern 31D and third pattern 31E are also shorter and thinner than first pattern 31A, second pattern 31B, and second pattern 31C. Still more, outer peripheral ends of third patterns 31D and 31E are darker than their centers. Meanwhile, third patterns 31D and 31E are formed near the center of diaphragm 14. Accordingly, widths of the outer peripheral ends and inner peripheral ends of third patterns 31D and 31E are almost same.

As described above, the outer peripheral end of pattern 31 is darker than the center, except for first pattern 31A. In other words, luminance of second pattern 31B, second pattern 31C, third pattern 31D, and third pattern 31E gradually darkens from the center of pattern 31 toward outside.

For the listener, a bright part and thick part of pattern 31 look closer to the listener. On the other hand, a dark part and thin part of pattern 31 look farther away from the listener. Since the above configuration gives gradation and different width to pattern 31, depending on areas in diaphragm 14, pattern 31 looks further three-dimensional.

Since a light image is formed by light reflected on the surface of diaphragm 14, the image has a shape along the surface shape of diaphragm 14. In general, the surface of diaphragm 14 is curved. Accordingly, when the light image is seen from a position deviated from the front of diaphragm 14, the light image looks curved. Accordingly, loudspeaker 11 can be decorated with an extremely complicated shape.

Since light of LED 16A reaches eye 51 via multiple routes, extremely complicated pattern 31 can be formed on diaphragm 14 even with only LED 16A. Therefore, if multiple LEDs 16 are disposed and illuminated, complicated geometric light pattern 31, as shown in FIG. 3, can be formed on diaphragm 14. For example, by illuminating the "n" number of LEDs, "n" pieces of first pattern 31A, second pattern 31B, second pattern 31C, third pattern 31D, and third pattern 31E can be formed.

When the "m" number, exceeding the "n" number, of LEDs 16 are disposed, the "n" number out of the "m" number of LEDs 16 may be illuminated. By selecting and illuminating the "n" number of LEDs 16 in the "m" number of LEDs 16 as required, diversifying patterns 31 can be formed on diaphragm 14. In addition, by disposing LEDs 16 with multiple colors, and illuminating them as required, diversifying patterns 31 with multiple colors can be formed on diaphragm 14. Furthermore, light emission from LEDs 16 may be linked to music. This configuration enables to form pattern 31 linked to music on diaphragm 14.

Figure 16:
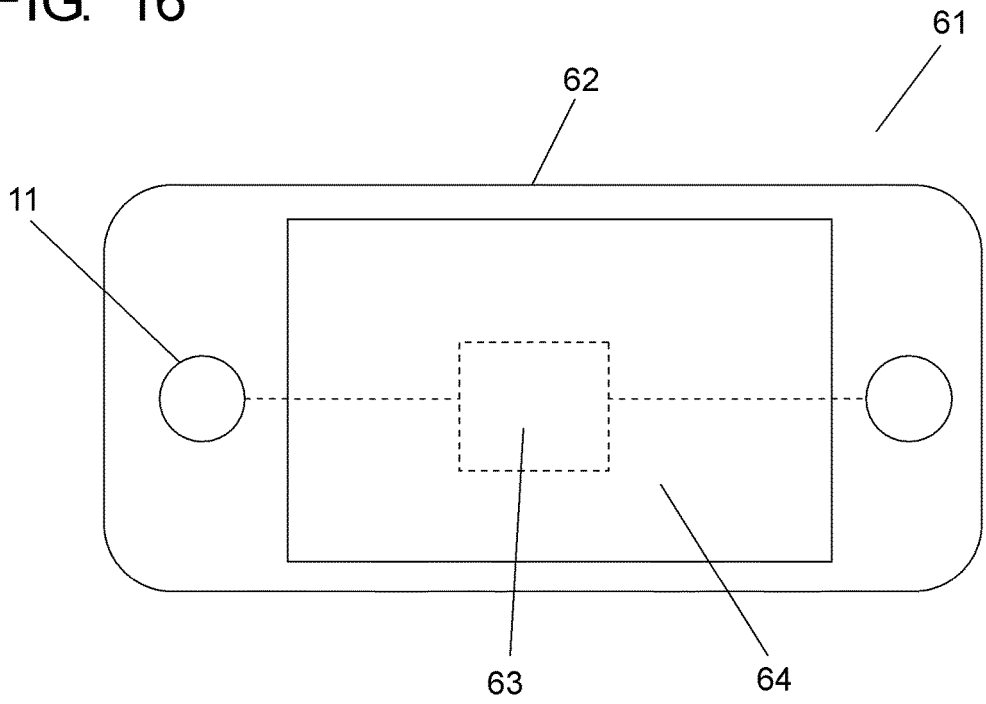
FIG. 16 is a conceptual diagram of an electronic apparatus in accordance with the exemplary embodiment of the present disclosure.

FIG. 16 is a conceptual diagram of electronic apparatus 61 in accordance with the exemplary embodiment. Electronic apparatus 61 includes casing 62, signal processor 63, and loudspeaker 11. Signal processor 63 and loudspeaker 11 are housed in casing 62. Signal processor 63 is electrically connected to loudspeaker 11. Signal processor 63 supplies signals to voice coil 15 and LEDs 16 shown in FIG. 1. With the above configuration, the listener listening to music output from loudspeaker 11 can visually enjoy music in addition to sound.

Signal processor 63 preferably supplies to LEDs 16 shown in FIG. 1 signals linked to signals supplied to voice coil 15. This configuration changes pattern 31 shown in FIG. 3 in line with sound. Signal processor 63 can also preferably stop supplying signals to voice coil 15 shown in FIG. 1. In this case, signal processor 63 supplies signals only to LEDs 16 in FIG. 1. This configuration enables to decorate loudspeaker 11 with pattern 31 shown in FIG. 3 even when the listener enjoys music using earphone or headphone.

Signal processor 63 may also include a reproducer for sound source and an amplifier. Still more, electronic apparatus 61 may include display part 64, such as a liquid crystal display. Electronic apparatus 61 having display part 64 can display a pattern linked to music on display part 64. However, power consumption becomes large if display part 64 is operated. On the other hand, since loudspeaker 11 can produce complicated pattern 31 just with a few LEDs, power consumption can be reduced.

Electronic apparatus 61 is, for example, a personal computer (PC). However, electronic apparatus 61 is not limited to PCs. For example, electronic apparatus 61 may be a smartphone, mobile phone, mobile apparatus such as tablet terminal, audio apparatus such as mini stereo audio system, or image apparatus such as a television set.

Figure 17:
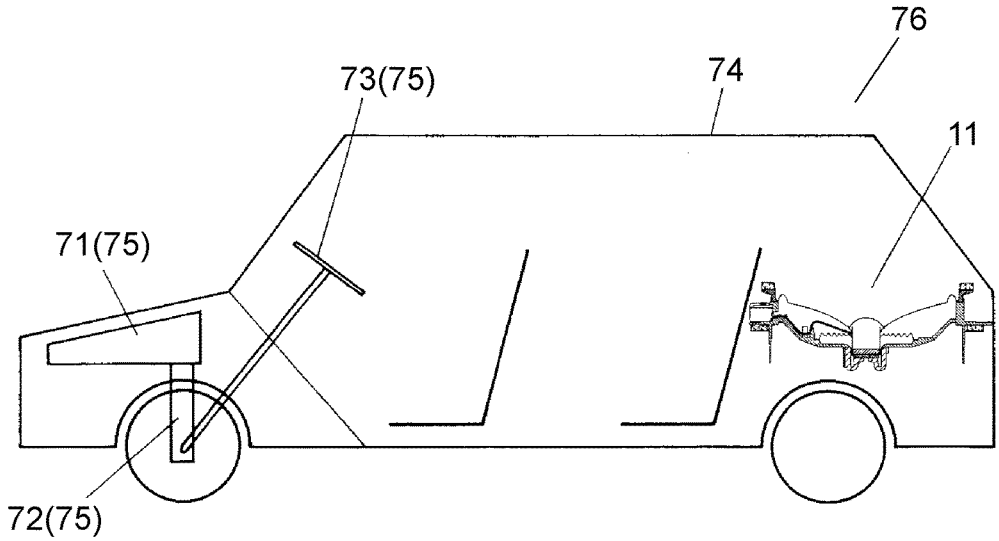
FIG. 17 is a conceptual diagram of a mobile apparatus in accordance with the exemplary embodiment of the present disclosure.

Hereinafter, a mobile apparatus in accordance with the exemplary embodiment is described with reference to FIG. 17. FIG. 17 is a conceptual diagram of mobile apparatus 76. Mobile apparatus 76 is, for example, a vehicle. However, mobile apparatus 76 is no limited to vehicle. It may also be motorcycle, bus, train, ship, airplane or the like.

Mobile apparatus 76 includes main body 74, driving unit 75, and loudspeaker 11. Driving unit 75 and loudspeaker 11 are installed to main body 74. Main body 74 preferably includes a body and chassis. Driving unit 75 includes power generator 71, power transmitter 72, and steering part 73. Steering part 73 includes a handle. Steering part 73 may also include tires. Power generator 71 is, for example, a motor or an engine. Power transmitter 72 transmits power generated in power generator 71 to the tires.

Loudspeaker 11 can be, for example, built in a rear tray. However, loudspeaker 11 may be installed in a front panel, door, ceiling, pillar, instrument panel, floor, or other place, besides the rear tray. Loudspeaker 11 can configure a part of car navigation system or car audio system.

Also in this example, same as electronic apparatus 61, power consumption of mobile apparatus 76 can be reduced, and thus fuel efficiency of mobile apparatus 76 can be improved. Accordingly, mobile apparatus 76 can contribute to global environmental protection.

As described above, the loudspeaker of the present disclosure has an effect that it can be decorated with illumination of a beautiful light pattern and/or image, and is applicable to, for example, electronic apparatuses and mobile apparatuses.

What is claimed is:

1. A loudspeaker comprising:

a frame having an upper part and a lower part opposite to the upper part;

a magnetic circuit connected to the lower part of the frame, and provided with a magnetic gap;

a cone-shaped diaphragm having a front face and a rear face opposite to the front face, the rear face being connected to an outer periphery of the frame, the diaphragm being made of resin;

a voice coil having a first end and a second end, the first end being connected to the diaphragm and the second end being inserted into the magnetic gap; and a light-emitting diode provided on the upper part of the frame, and disposed so as to output light toward a center of the diaphragm and the diaphragm reflects the light, wherein the diaphragm has a plurality of annular convex parts projecting from the front face of the diaphragm, and each of the plurality of annular convex parts is concentric to the diaphragm and to each other.

2. The loudspeaker according to claim 1, wherein each of the plurality of annular convex parts is arc-shaped in cross section.

3. The loudspeaker according to claim 1, wherein a height of each of the plurality of annular convex parts is not less than 0.01 mm and not greater than 0.07 mm.

4. The loudspeaker according to claim 1, wherein the light-emitting diode is one of a plurality of light-emitting diodes disposed away from each other at equivalent intervals.

5. The loudspeaker according to claim 1, wherein the front face of the diaphragm has a color with a reflectivity higher than that of the rear face.

6. The loudspeaker according to claim 1, wherein the diaphragm includes a main resin material and a sub resin material with a reflectivity higher than that of the main resin material, and the sub resin material is contained in the main resin material.

7. The loudspeaker according to claim 1, further comprising a dust cap provided at the center of the diaphragm and protruding from the diaphragm toward the magnetic circuit.

8. The loudspeaker according to claim 1, further comprising a dust cap including a first face and a second face having a color with a reflectivity higher than that of the first face, the dust cap being provided at the center of the diaphragm such that the first face faces the magnetic circuit.

9. The loudspeaker according to claim 1, further comprising a dust cap provided at the center of the diaphragm, and including a main resin material and a sub resin material with a reflectivity higher than that of the main resin material.

10. An electronic apparatus comprising:

a casing;

an amplifier housed inside the casing; and the loudspeaker according to claim 1 electrically connected to the amplifier and housed inside the casing.

11. A mobile apparatus comprising:

a main body;

a driving apparatus installed in the main body; and the loudspeaker according to claim 1 installed in the main body.

* * * * *